US005388557A

United States Patent [19]

Berg

[11] Patent Number: 5,388,557

[45] Date of Patent: Feb. 14, 1995

[54] COMBUSTION ENGINE HAVING A SUBSTANTIALLY CONSTANT TEMPERATURE AND PRESSURE

[76] Inventor: Tore G. O. Berg, Backavägen 18, S-810 40 Hedesunda, Sweden

[21] Appl. No.: 156,771

[22] Filed: Nov. 24, 1993

Related U.S. Application Data

[63] Continuation-in-part of Ser. No. 12,461, Feb. 2, 1993, abandoned, which is a continuation-in-part of Ser. No. 861,438, Apr. 1, 1992, Pat. No. 5,233,966, which is a continuation-in-part of Ser. No. 628,683, Dec. 17, 1990, abandoned.

[30] Foreign Application Priority Data

Nov. 12, 1990 [SE] Sweden ..... 9003593

[51] Int. Cl.[6] ..... F02B 53/06

[52] U.S. Cl. ..... 123/202; 123/200

[58] Field of Search ..... 123/200, 202, 568

[56] References Cited

U.S. PATENT DOCUMENTS 2,061,049 11/1936 Spellman ..... 123/202

3,168,078 2/1965 Lamm ..... 123/202

FOREIGN PATENT DOCUMENTS 4101021 4/1992 Japan ..... 123/200

*Primary Examiner*—Richard A. Bertsch

*Assistant Examiner*—Charles G. Freay

*Attorney, Agent, or Firm*—Popham, Haik, Schnobrich & Kaufman, Ltd.

[57] ABSTRACT

Combustion engine of high efficiency comprising a stator and a rotor, a duct shaped as a closed circle between said stator and rotor, at least one vane sliding in the duct and being fastend to the rotor, wherein the expansion takes place at a substantially constant temperature and at a substantially constant pressure. Alternatively, the combustion engine is designed as a generator of a voltage, with the at least one vane being a permanent magnet sliding in the duct, and with field coils being arranged adjacent the duct for the induction of a voltage.

8 Claims, 2 Drawing Sheets

COMBUSTION ENGINE HAVING A SUBSTANTIALLY CONSTANT TEMPERATURE AND PRESSURE

This application is a continuation-in-part (CIP) of U.S. patent application Ser. No. 08/012,461, filed Feb. 2, 1993, (pending through the filing date of the present patent application and abandoned Nov. 11, 1993), which is a continuation-in-part (CIP) of U.S. patent application Ser. No. 07/861,438, filed Apr. 1, 1992, (now issued as U.S. Pat. No. 5,233,966 on Aug. 10, 1993), which in turn was a continuation-in-part (CIP) of U.S. patent application Ser. No. 07/628,683, filed Dec. 17, 1990, (now abandoned).

FIELD ON THE INVENTION

This invention refers to a combustion engine of high efficiency operating according to the principles that a gas expands at a constant temperature by injection of fuel and air or oxygen or their reaction products during the expansion, and that the gas from a previous expansion is returned to the expansion chamber during the expansion in such a manner that the pressure of the expanding gas is also constant.

BACKGROUND OF THE INVENTION

The basic principle of the conventional combustion engine is the adiabatic expansion of a compressed and heated gas in such a manner that part of the energy of the gas is converted into mechanical work. The simplest engine based on this principle is a cylinder with one closed and one open end and a sliding piston in it that is pushed by the expanding gas towards the open end. The motion of the piston is transmitted to a crankshaft by means of a connecting rod. The literature on combustion engines mentions no other principle than the adiabatic expansion principle because none other has been used in the recent 150 years. To a person familiar with the theory and the practice of the combustion engine it will, therefore, appear that no other type of expansion can be used in a combustion engine. The description of the invention must therefore connect to the conventional engine as the point of reference.

The state of a gas is always in agreement with the gas law $$pv=NRT$$

where p is the pressure, v the volume, N the quantity in mols, R the universal gas constant, and T the absolute temperature. Among the four variables p, v, N, and T, any 2, 3 or 4 may vary in a change of state. The textbooks on thermodynamics that treat the general subject usually assume that N is constant during the change of state. On this condition adiabatic expansion is defined as a change at constant entropy $$\frac{pv}{T} = NR = \text{const.}$$

or as a change of state without exchange of heat with the environment. Isothermal expansion is then defined as a change of state at constant temperature T $$pv=NRT=\text{const.}$$

According to the invention, the change of state occurs at constant pressure p and constant temperature T $$\frac{v}{N} = \frac{RT}{p} = \text{const.}$$

Textbooks that give the gas law for one mole, N=1, of the gas may give the impression that expansion at constant T and constant p is not possible because then, at a constant N=1, v would also be constant, i.e. there would be no change.

The conventional engine operates in cycles of four strokes. A stroke is the displacement of the piston from one extreme position, $x_1$ to the other extreme position $x_2$ with $x_2>x_1$. The cycle is terminated when the spent gas has been exhausted, and the piston is in the position $x_1$. The first stroke of the next cycle sucks air from outside into the cylinder and mixes it with injected gaseous fuel. The second stroke compresses this gas. In the position $x_1$, at the beginning of the third stroke, the fuel is ignited. Then follows the third stroke that delivers work to the crankshaft. The fourth stroke exhausts the spent gas. FIG. 1, a graph from a common Engineer's handbook shows p against v for the three strokes following upon the first, suction, stroke. The abscissa $\epsilon$ is the compression ratio. Two scales are marked on the ordinate, the absolute pressure and the pressure above atmospheric. The smaller loop represents a rapidly burning fuel that is ignited at $\epsilon=0.2$,p=9. The pressure increases from the heat supplied almost vertically to p=26. Then follows the expansion under delivery of work to the crankshaft. The larger loop represents a slowly burning fuel, the heating curve is in this case almost horizontal. The more slowly the fuel burn, the more the adiabatic expansion approaches isothermal expansion. For the adiabatic expansion $$pv^{\kappa}=\text{const.}$$

with $\kappa=1.4$ for a diatomic gas, such as air. For the isothermal expansion $\kappa=1$. The result is a polytropic expansion with $1<\kappa<1.4$. The heat loss through the wall of the cylinder has an effect in the same direction. As a consequence the curves of p against v for the compression and for the expansion in FIG. 1 are polytropic. Clearly, the more isothermal the expansion is, the smaller is the temperature drop during the expansion. The work done in the adiabatic expansion is $$W = \frac{p_1 v_1}{\kappa - 1}\left(1 - \frac{T_2}{T_1}\right) = \frac{p_1 v_1}{\kappa - 1}\left[1 - \left(\frac{p_2}{p_1}\right)^{\frac{\kappa-1}{\kappa}}\right] = \frac{p_1 v_1}{\kappa - 1}\left[1 - \left(\frac{v_1}{v_2}\right)^{\kappa-1}\right]$$

where indices 1 and 2 denote start and end of the expansion. Thus, for the adiabatic expansion, $\kappa=1.4$., the value of W increases with the temperature drop during the expansion. For the isothermal expansion $\kappa=1$ and $T_2=T_1$ and W is equal to the heat supplied during the expansion, but $T_2$ and $P_2$ are much larger than for the adiabatic expansion. Much more energy is exhausted with the spent gas in isothermal expansion than in adiabatic expansion. The net result is that the advantages of the isothermal expansion are worthless unless the spent gas is recovered and used again in the following cycle.

At the end of the cycle in FIG. 1, $P_2$ and $T_2$ are much greater than at the start of the cycle. In order to use the exhaust gas in a following cycle, at the same compression ratio, it would be necessary to reduce its pressure and its temperature. But then, of course, so much less of its energy would be recovered. After compression and heating the gas shown in FIG. 1 is so hot and gives off so much heat to the wall, that the engine would be ruined in a very few cycles unless the wall is very effectively cooled.

In the case of the isothermal expansion, T is the same at the end of the stroke as at the start of the stroke, but p is reduced proportionally to the expansion ratio. The pressure could be restored by compression, but then the temperature would increase correspondingly unless, of course, the compression is isothermal. This means that all the work done in the preceding stroke would be converted into heat in the coolant.

The conventional engine receives work and heat and delivers more work and less heat. It converts heat to work and also work to heat. The net amount of heat converted to work is represented by the area inside the closed loop in FIG. 1. Compression is reversible. The work received as work of compression in the stroke of compression is delivered as work of expansion in the following stroke of expansion. At the transition from the former stroke to the latter the engine received heat from the burning fuel. The reversibility is not perfect, however. The compression raises the temperature of the compressed gas and, therefore, the loss of heat through the wall of the cylinder. The reason for the compression is that it is a means to controlling the rate and the completion of the combustion of the fuel. These considerations are not so important now as they used to be because in recent years equipment has become available that allows the complete control of the outside combustion and the injection of the hot products into the engine in determined amounts and at determined intervals and sequences.

SUMMARY OF THE INVENTION

According to the invention, the exhaust gas is returned to the expansion chamber, and its energy is used in a following expansion so that this energy loss is eliminated. Furthermore, according to the invention, the pressure and the temperature are held substantially constant during the expansion and, in principle, at the average values of those of the conventional engine so that, in particular, the temperature is reduced to a level that the material from which the engine is made, can endure.

Therefore, no cooling is needed, and the loss of energy by cooling is also eliminated. As a consequence, the efficiency of the utilization of the energy of combustion is greatly increased at a given output of power and even at a greater output of power.

The combustion engine according to the invention operates at a substantially constant temperature and at a substantially constant pressure. This leads to the advantage that no cooling is needed and the heat losses are minimized. The heat in the exhaust is substantially completely utilized which considerably increases the efficiency of the engine.

Further advantages and characterizing features will become evident from the following detailed description.

The conventional combustion engine, such as it is used in automobiles, utilizes roughly $\frac{1}{3}$ of the energy content of the fuel as useful work, about $\frac{1}{3}$ is lost through the exhaust pipe, and about $\frac{1}{3}$ is lost to the coolant. According to the invention, the exhaust loss is avoided by reusing the spent gas, and the loss by cooling is avoided by operating the engine at a constant temperature that it can endure. How this is accomplished is described in the following.

SHORT DESCRIPTION OF THE DRAWINGS

In the drawings,

FIG. 1 schematically shows a graph p rs. V for the strokes of a conventional combustion engine, FIG. 2 schematically shows a cross sectional view of a combustion engine according to the invention, FIG. 3 shows a modification of the engine according to FIG. 2, FIG. 4 shows a development of the engine according to the invention, working as a generator.

DETAILED DESCRIPTION OF THE INVENTION AND PREFERRED EMBODIMENTS

In all figures, arrows show the directions of movement of elements and fluids.

Figure 1:
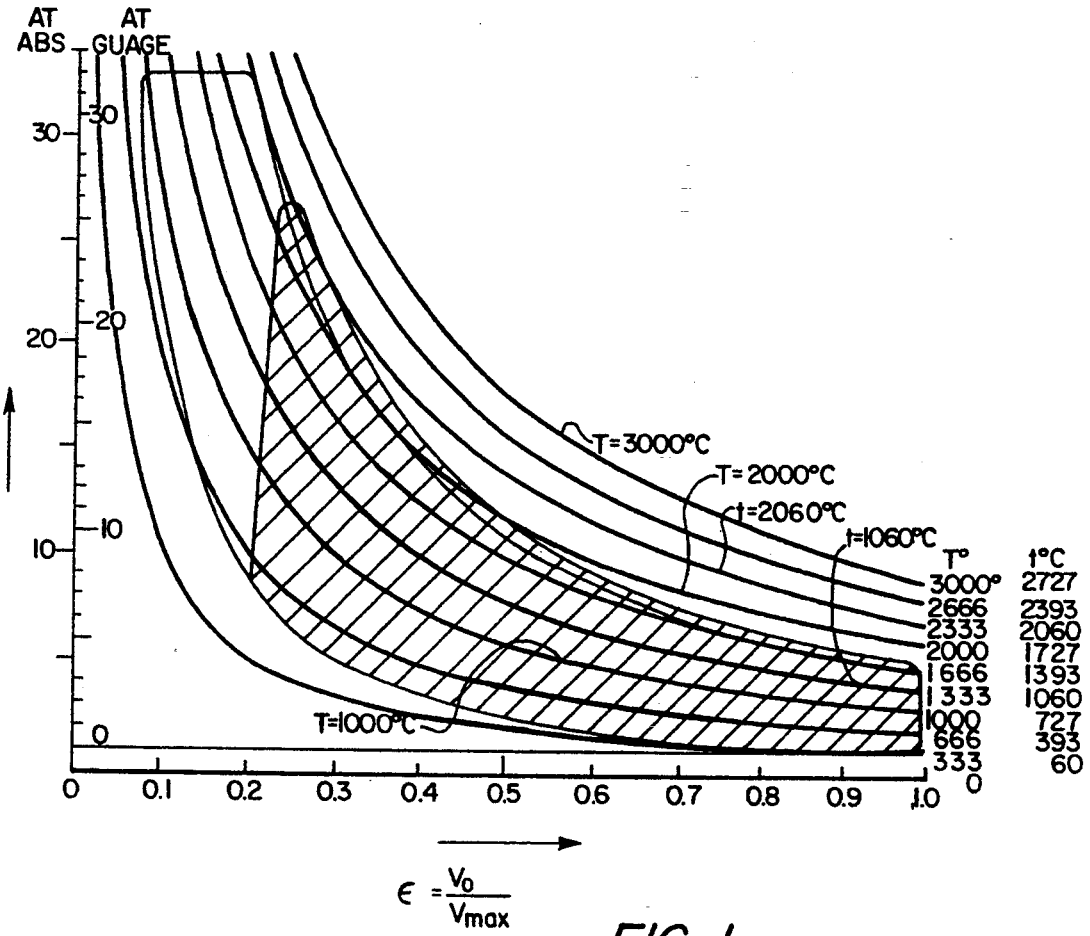
FIG. 1 PRIOR ART
Figure 2:
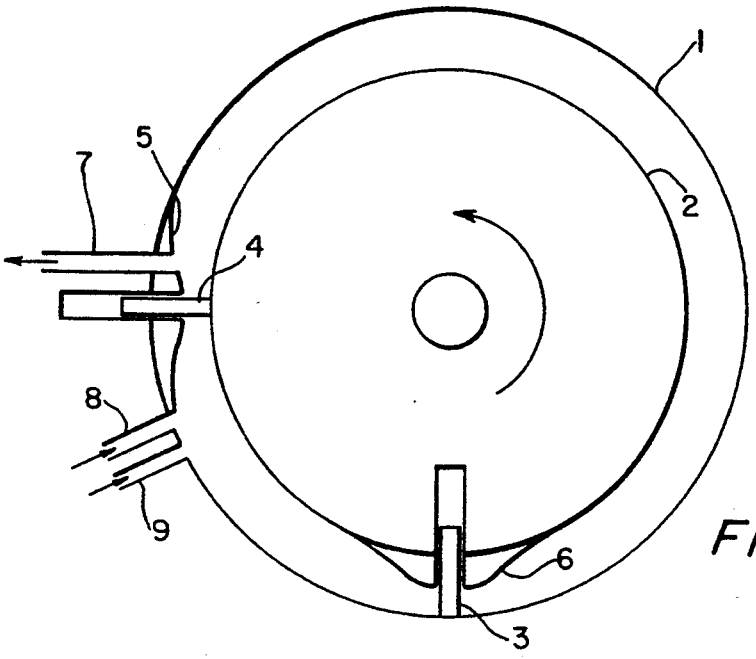

FIG. 2 shows the basic elements of the invention. The cylinder considered in the preceding section is bent into a circle and the piston 3 has the form of a vane. The cylinder is divided into two tubular parts, a stationary part i and a rotating part 2. The rotor is mounted on a rotating shaft through its center. The shaft turns in the direction of the arrow. Gas at p and T is supplied through the tube S, hot gas for maintaining T through the tube 9. The hot gas can be the hot gas combustion products of fuel and oxygen or of fuel and air. The cylinder is closed by a disc 4 mounted in the stator 1. The gas in front of the moving vane 3 s exhausted through the tube 7. In order for the vane 3 to pass the disc 4, the surfaces against which they slide are raised by embossments 5 and 6 that push the disc and the vane radially into groves in the rotor and the stator.

The engine according to the invention is an assembly of the basic units shown in Fig, 2, all mounted on the same shaft. They are interconnected so that the exhaust of one unit through the tube 7 is fed into an adjacent unit through the tube 8. In practice it is preferable to replace the two tubes by a hole through the walls of the two units. In order to ensure the heating of the entire volume of the gas between the vane 3 and the disc 4 one may place several tubes 9 along the circumference that are opened and used when the vane has passed. The quantity of hot gas added through the tube 9 per revolution may amount to 10% of the total quantity of gas. In order to maintain p and T constant it is, therefore, required that as much gas be exhausted to the environment or collected and used for some purpose outside the engine.

Figure 3:
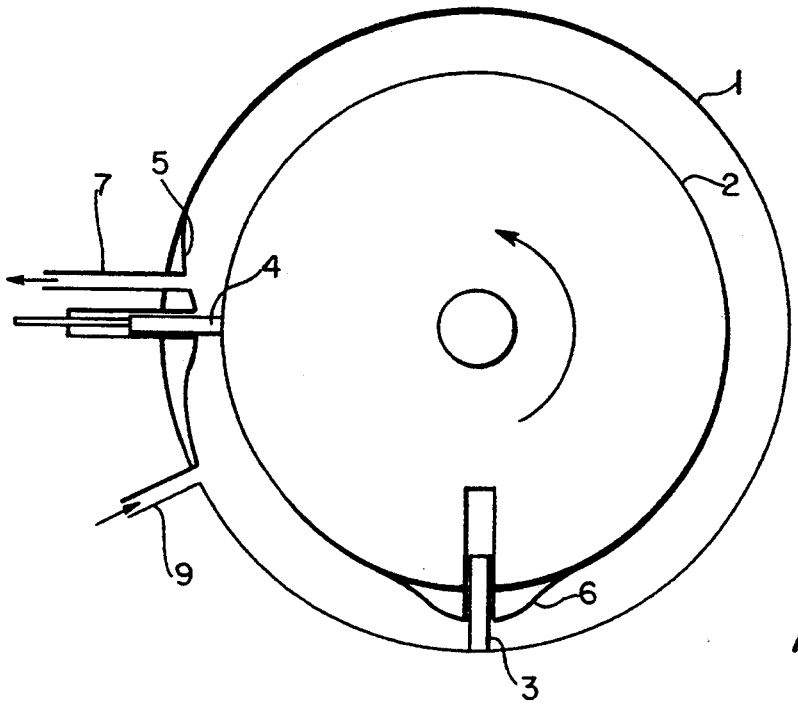

Instead of conducting the exhaust through the outlet tube 7 to the inlet tube 8 of another unit, one might as well connect the tubes 7 and 9 of the same unit. This has the same effect as removing the inlet tube 8. Such a unit is shown in FIG. 3. The functioning of this unit will now be described.

For clarity the disc 4 will be called the gate. When the gate is open, the pressure of the gas is the same all through the cylinder. At this state the gate is closed, and hot gas is injected through the tube 9. The gas behind the vane then expands and moves the vane thereby delivering work to the shaft. The motion of the vane also compresses the gas in front of the vane. At a suitable time the gate is opened. The compressed gas then expands into the volume behind the vane. When the state of the gas has become the same all through the cylinder, the gate is closed and hot gas is injected through the tube 9. The work of compression received from the vane by the gas in front of the vane when the gate is closed, is delivered as work of expansion to the vane when the gate is open.

Figure 4:
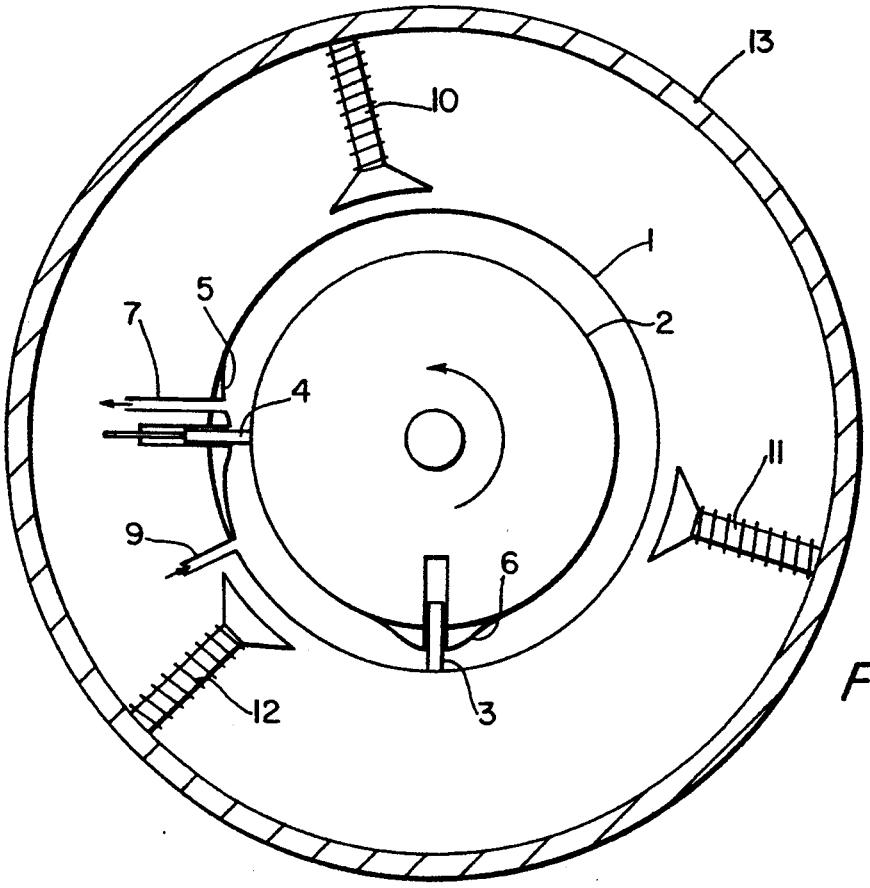

In a further variation of the combustion engine working according to the inventive principle, the motor is acting as a generator. One embodiment of the generator is schematically illustrated in FIG. 4. At least one permanent magnet in the form of the vane 3 is circulated with the rotor 2 with heating gas in the form of a fuel and oxygen or air, or the hot gaseous combustion products thereof, injected through the inlet 9 and the exhaust withdrawn through the outlet 7, as according to the previous embodiments, illustrated in FIGS. 2 and 3. A voltage is induced in coils, which are schematically illustrated at 10, 11 and 12, and being interconnected through a magnetic core 13. The illustrated arrangement is very simple, but since magnetic induction of a voltage as such is well known for the man skilled in the art, a detailed discussion and illustration of this is believed to be superfluous in this context.

I claim:

1. Combustion engine of high efficiency comprising a stator and a rotor, the stator being shaped as a duct in the form of a closed circle, a moving vane being fastened to the rotor and sliding in the duct and moving in a circular direction, the duct being filled with a gas at a pressure and a temperature greater than those of the ambient air, said gas streaming in the duct in the direction of the moving vane gas behind the moving vane being maintained at a substantially constant temperature by means for injecting a heating gas behind the moving vane, and the gas behind the moving vane being maintained at a substantially constant pressure by means for supplying gas from in front of the moving vane, while an amount of gas equal to the injected amount of heating gas is exhausted from in front of the moving vane an inlet and an outlet being provided for the injection of heating gas and exhaust of gas, respectively.

2. Combustion engine according to claim 1, wherein the heating gas is a fuel and oxygen.

3. Combustion engine according to claim 1, wherein the heating gas is a fuel and air.

4. Combustion engine according to claim 1, wherein he heating gas is the hot gaseous combustion products of a fuel and oxygen.

5. Combustion engine according to claim 1, wherein the heating gas is .the hot gaseous combustion products of a fuel and air.

6. Combustion engine according to claim 1, wherein said vane sliding in the duct is fastened to a motor that rotates about an axis through the center of the said rotor, while the said circular duct is stationary.

7. Combustion engine according to claim 1, wherein there is a constriction of the duct between said inlet and said outlet.

8. Combustion engine of high efficiency acting a generator, comprising a duct in the form of a closed circle, a moving vane sliding in the duct and moving in a circular direction, the vane being a permanent magnet, and field coils being arranged adjacent the duct for the induction of a voltage, the duct being filled with a gas at a pressure and a temperature greater than those of the ambient air, said gas streaming in the duct in the direction of the moving vane, gas behind the moving vane being maintained at a substantially constant temperature by means for injecting a heating gas behind the moving vane, and the gas behind the moving vane being maintained at a substantially constant pressure by means for supplying gas from in front of the moving vane, while an amount of gas equal to the injected amount of heating gas is exhausted from in front of the moving vane an inlet and an outlet being provided for the injection of heating gas and exhaust of gas, respectively.

* * * * *